United States Patent [19]

Salmon

[11] Patent Number: 5,030,976

[45] Date of Patent: Jul. 9, 1991

[54] ELECTRODIELECTRIC PRINTING APPARATUS AND PROCESS

[76] Inventor: Peter C. Salmon, 70 Angela Dr., Los Altos, Calif. 94022

[21] Appl. No.: 470,444

[22] Filed: Jan. 19, 1990

Related U.S. Application Data

[63] Continuation-in-part of Ser. No. 433,464, Nov. 9, 1989, abandoned.

[51] Int. Cl.[5] ..... G03G 15/01

[52] U.S. Cl. ..... 346/157; 355/326

[58] Field of Search ..... 346/157; 358/300; 355/326

[56] References Cited

U.S. PATENT DOCUMENTS 4,125,322 11/1978 Kaukeinen et al. ..... 355/326

4,733,256 3/1988 Salmon ..... 346/157

*Primary Examiner*—George H. Miller, Jr.

*Attorney, Agent, or Firm*—Thomas E. Schatzel

[57] ABSTRACT

A color printer system comprising a toner drum with a plurality of compartments for storing supplies of toner of differing colors, an imaging medium having a plurality of electodes arranged in a pixel format at the imaging medium being movable relative to the toner drum and having a surface about the electrodes for receiving toner emitted from the toner drum as the toner drum is positioned adjacent to the imaging medium, means for controlling electrical potential to the electrodes in a programmed manner consistent with a desired format, such that the toner particles are transferred and arranged on the imaging medium in a format consistent with that to be printed, means for transferring the formatted toner to a print medium and fuser means for fusing the toner to the medium.

35 Claims, 12 Drawing Sheets

ELECTRODIELECTRIC PRINTING APPARATUS AND PROCESS

This is a continuation-in-part of copending application Ser. No. 07/433,964 filed on Nov. 9, 1989 now abandoned.

BACKGROUND OF THE INVENTION

This is a continuation-in-part of copending application Ser. No. 07/433,964 filed on Nov. 9, 1989 now abandoned.

1. Field of the Invention

The present invention relates to electronic printing and more particularly to the electrodielectric printing apparatus and process as it applies to monochrome and color print engines and toners.

2. Description of the Prior Art

U.S. Pat. Nos. 4,733,256 and 4,777,500, issued to Salmon, describe an electrostatic color printer utilizing a rotating toner drum and an imaging printhead that pulls toner from the drum by coulomb forces. The described embodiments include imaging through orifices in special purpose integrated circuits, as well as imaging by a planar surface with no orifices. Limitations to such printers arise due to the fact that imaging orifices are too easily plugged by dust in the environment. Also, the requirement to charge the toner in order to create coulomb imaging forces results in substantial complexity in the printing machines that have heretofore been described.

There is a need for print engine architectures that are built to optimize the advantages of toners with high relative dielectric constants. High dielectric toners can be imaged by dielectric forces rather than coulomb forces. The dielectric force is created by a charge polarization on the toner particle rather than a net positive or negative charge required for imaging of point charges according to Coulomb's law of electrostatic attraction. The new print engine architectures should avoid the need for imaging orifices and should enable color printer designs that offer simultaneously high resolution, high speed, and sophisticated color capabilities. There is also a need for new dielectric toner materials that can be imaged using relatively weak electrical fields.

SUMMARY OF THE PRESENT INVENTION

An object of the present invention is to provide a color print engine that operates reliably, and is small in size and weight.

Another object of the present invention is that color printing can be achieved using a single pass of the receiving sheet past the writing head.

Another object of the present invention is that high quality prints and transparencies can be obtained on untreated print media such as plain paper or clear acetate sheet.

Another object of the present invention is to provide a print engine of operational versatility by means of programmable print resolutions and color depths, and which programmable features are available independently for each print.

Another object is that the programmable features be invokable without causing any measurable delays in the printing time.

It is another object of the present invention to provide a print engine which allows for data interruptions during a print, and without impairing the print quality relative to that for uninterrupted data.

It is a further object of the present invention to provide a color print engine which operates quietly in an office environment.

It is a further object of the present invention to provide a color print engine which operates at very low power.

It is another object of the present invention to provide a printing process that utilizes high dielectric toners to enable high performance color printing machines that offer simplicity of design as well as high printing performance.

Another object of the present invention is to provide toners that can be imaged using driver circuits contained within monolithic integrated circuits that include associated logic and memory circuits.

A further object of the present invention is to provide a toner material that is capable of high resolution printing as a simple monocomponent toner.

Another object of the present invention is to provide a toner material that does not require charging to be imaged, thereby eliminating the process steps for charging and discharging the toner and the need to tightly control the toner charge distribution which is a major problem with conventional print engines employing charged toners.

A further object of the present invention is to provide a toner material that is capable of bright color images because it is translucent to light wavelengths in the visible spectrum.

Briefly, there are four preferred embodiments of the print engine apparatus of the present invention. The first embodiment employs a dual drum architecture of a toner drum and an imaging drum. A second embodiment employs a toner drum plus a transfer belt to deliver the imaged toner to the print medium. A third embodiment utilizes a conventional photoconductive drum to replace the imaging drum of the dual drum architecture. A fourth embodiment employs a writing drum assembly that transfers imaging potentials from a stationary inner cylinder to a rotating outer cylinder, and a charge receptor drum comprised of a high dielectric material such as $BaTiO_3$.

The first preferred embodiment includes two geometrically similar drums which are counter-rotated in synchronism. One drum is a toner drum with four inner compartments to contain toners of different colors, e.g. yellow, cyan, magenta, and black. During operation, the toner drum is rotated about the axis and centrifugal forces cause the toner particles to migrate from their respective compartments toward toner feed holes at the outer surface of the drum.

If the toner is trapped in a cavity, then centrifugal forces tend to pack the powder into an agglomerate that cannot be imaged. To overcome the packing effects of the centrifugal forces, grid wires are provided within the compartments and in the path of the toner as it migrates toward the toner feed hole. Each of these grid wires is connected to a square wave voltage signal that is switching between a high voltage and ground at a frequency of approximately one kilohertz. When the applied voltage is positive, toner is attracted to the grid wire. When it is ground, there is no attraction. Each wire is switched in opposite phase from its neighbor wire. Thus the toner particles are alternately attracted to different grid wires, and the effect is to agitate the toner such that individual toner particles can migrate through the nylon screen and into the toner feed holes. The nylon screen is sufficient to block the path of the toner when the toner drum is not rotating and thus contains the toner when the power is off.

The feed hole has an expanding diameter along the toner path to alleviate packing of the toner. After exiting the feed hole, the toner forms a regular shaped bump at the outer peripheral surface of the toner drum. The bump is restrained from flying off the surface by potentials applied at a pair of electrodes embedded in the toner drum wall about the opening of the feed hole. The embedded electrodes may be made by a molded circuit board process during manufacture of the toner drum. The un-imaged toner resides as a bump on the toner drum surface while the corresponding quadrant of the imaging drum rotates into adjacent position. At such point in time, there is a minimal gap between the outer region of the toner bump and imaging electrodes located on the surface of the imaging drum. Since the toner and imaging drums are synchronously locked together as they rotate in opposite directions, there is no relative motion between the toner drum surface and the imaging drum surface as toner transfer occurs between the two surfaces, i.e. the toner drum surface to the imaging drum surface.

The imaging electrodes located on the surface of the imaging drum may be of the molded process for manufacturing three-dimensional circuit boards which combines electrical and mechanical design elements. One technique involves creating a multi-layer circuit by screen printing conductive and resistive inks onto a plastic decal. The printed decal is inserted into the injection molding die prior to the molding cycle of the drum and is captured in the molded drum part. The current state-of-the-art for screen printing inks is between six and ten mils for lines and spaces, and up to four layers of circuitry are achievable.

The space gap at the tangent between the toner drum and the imaging drum is an important dimension. Thus, it is necessary to consider thermal expansion effects in the molded drum materials. For this reason, the walls that support the bearings at each end of the drums are preferrably thermally matched to the material used to fabricate the drums.

The imaging drum surface facing the un-imaged toner bump has a linear array of metal electrodes, each electrode centered within a conducting grid. The conducting grid is at ground potential and the center electrode can be driven to a positive voltage, to ground, or can remain in a high impedance state. The conductors may be protected by a thin film wear layer. To accommodate the programmable pixel size and very high print resolutions, the metal electrodes may be patterned with a finer pitch than is generally possible with screening methods. This is achieved by patterning the plastic decal with a multi-layer thin film circuit prior to insertion in the mold. Between one and sixty-four electrodes are driven in parallel to achieve printing resolutions ranging from thirty-two dots/mm to four dots/mm, respectively. In addition to the programmable size of each pixel, the positive voltage applied to each electrode during imaging is programmable between different values, e.g. between four values. Higher voltages result in transfer of more toner to the imaging electrode when the electrode emerges from close proximity with the toner drum surface. Each of the four voltage levels results in a different amount of toner captured at the imaging electrode, such that programmable pixel depth is provided. In a single rotation of the imaging drum, four levels of toner are selectable for each of the four toner colors, resulting in 256 possible color combinations for a single rotation. If image deposits from two rotations of the drum are captured before the paper is advanced then there are eight levels of each toner color and 4096 possible color combinations. Similarly, three rotations provide twelve levels of each toner color and 20,736 theoretical color combinations. A user can select resolution and pixel depth according to convenience. For example, draft prints may be obtained very quickly at a combination including low resolution and limited color depth. Once the draft print is correct, a final print at very high resolution and color accuracy can be obtained with longer print time.

Composite toner particles may be manufactured with a mean diameter of approximately eight microns. The composite particle may consist of primary particles of a high dielectric material such as $BaTiO_3$ embedded in a matrix of translucent materials. The primary particles may have a maximum diameter of approximately 0.1 microns. At this size, incident light waves in the visible spectrum diffract around the primary particles rather than being absorbed. The primary particles may represent approximately 40% by weight of the composite toner particle. The translucent materials may include a resin binder, pigment, and additives with approximate percentages by weight of 50%, 8% and 2%, respectively.

To maximize the effective dielectric constant of the composite toner particles during imaging, the primary particles of high dielectric material are distributed around the periphery of the composite toner particles. When the image is fused, the distribution of primary particles within the matrix of translucent materials preferrably approaches a uniform distribution which is desirable for maximum color brightness of the image. The initial distribution of the primary particles about the periphery has been achieved in the industry using special coating machines or by heat spheroidization processes. Using $BaTiO_3$ as the primary particle material, it has been calculated that effective dielectric constants of approximately 400 can be achieved for the composite toner particles.

The printer engine includes an image transfer means comprising a blade electrode positioned below the receiving sheet and a pair of ground wires positioned above the receiving sheet. The imaged toner on the surface of the imaging drum rotates around, held by the electric field of the imaging electrodes, until the imaged toner is positioned above the blade electrode. When the imaged pixel line is in the correct position, the attractive potentials on the imaging electrodes are released, and a strong negative pulse is applied at the blade electrode. A focused electric field is generated between the blade and the two grounding wires. Since the dielectric toner is attracted along the gradient of the electric field, centering forces pull the toner off the imaging drum and on to the receiver sheet.

An optical encoder is attached to one end of the imaging drum to provide the angle of rotation to the imaging electronics. Also, driver circuits for the imaging electrodes are located on the outer surface of the drum within recessed areas between lobes of the cylindrical molding.

After contacting the receiving sheet, the toner is moved with the print medium by a stepper motor whose step size depends on the programmed pixel size. Also the timing between steps allows 1, 2, 3 or more rotations of the imaging drum, depending on the programmed pixel depth. The fuser applies heat and pressure to the imaged medium as it passes through. This causes the toner to be permanently bonded to the print medium, and when the image is completed the print medium sheet is ejected from the printer. Continuous rolls of print medium can also be used.

Both the toner drum and the imaging drum have slip rings and wiper assemblies at one end to provide power to the rotating assemblies. A high voltage square wave, positive voltages and ground are provided to the toner drum, and positive voltages and ground are provided to the imaging drum.

A data transmission means transfers the external image data to the driver circuits on the imaging drum. This includes an optical data link which provides a high speed serial data link to the rotating circuits on the imaging drum. The print engine controller resides on a fixed printed circuit board, and includes the data interface for print data arriving from the external information source. An optical transmitter/receiver pair are aligned along the axis of the imaging drum. The receiver is centered in the end of the imaging drum shaft which is hollow to allow the axial alignment. Thus, even with the imaging drum rotating at high speed, a continuous data path is provided.

Loading and ejection of the cut sheets of print medium are handled by the printer that contains the print engine. Paper advance mechanisms are employed for advancing the paper and the print engine provides for advancing the medium during the imaging process.

The second preferred embodiment is similar to the first. However, the toner drum may contain more than four toner compartments within a simple cylinder. The toner cylinder does not require the lobes as in the dual drum embodiment. The imaging electrodes are contained on a stationary molded circuit. A thin transfer belt is positioned to travel between and simultaneously intermediate to the toner drum and the imaging electrodes. The fusing process combines means for pick-off of the toner from the transfer belt onto the print medium and then fusing of the toner onto the print medium.

Relative to the first preferred embodiment, the second preferred embodiment is capable of operating at higher speed because there are more imaging opportunities per rotation of the toner drum. Also, the imaging electronics are contained on a stationary circuit assembly. However, the presence of the transfer belt between the imaging electrodes and the toner drum may result in reduction of maximum print resolution. Also, the belt may tend to lessen overall durability of the system. Also, mechanisms are required to maintain straight tracking of the belt. Furthermore, due to the presence of the belt, the imaging potential will need to be greater than that for the first embodiment because the belt is a dielectric material and has the effect of shunting some of the electric field away from the toner.

The third preferred embodiment includes conventional writing circuits to form a charged image on a photoconductive drum. The charge image includes raster scans of image patterns for each color, separated by inactive spaces. Toner is presented to the surface of the photoconductive imaging drum using a toner drum that is similar to that of the first preferred embodiment, except that its shape is a simple cylinder and it may contain a greater number of toner compartments. The toner and imaging drums counter rotate in synchronism, as for the first preferred embodiment. The high dielectric toner at the surface of the toner drum is transferred to the imaging drum at the line of contact between them, in response to the charge image on the photocondutive surface of the imaging drum.

Relative to the first preferred embodiment, the third preferred embodiment is potentially capable of higher printing speeds at lower rotational speeds because of the large number of toner compartments in the toner drum, each compartment corresponding to a potential imaging cycle. The photoconductive drum and optical image writing circuits represent a mature technology that can be extended to a high performance direct marking color engine using dielectric toners.

The fourth preferred embodiment employs a drum of high dielectric material such as $BaTiO_3$ as a charge receptor. Since the bulk material from which the drum is made can have relative dielectric constants as high as 2,000, pairs of planar electrodes on the surface of the drum can have significant capacitance between them. A high capacitance means that a high imaging charge can be placed on the imaging electrodes with a low imaging voltage. A novel scheme is used to write image data to the charge receptor drum. Ring electrodes around the circumference of a third writing drum assembly make contact with the imaging electrodes of the charge receptor drum along a pixel line which is the line of contact between the two drums. The ring electrodes are charged synchronously with the rotation from each pixel line to the next pixel line; the imaging potentials are switched in a "dead space" between lines of electrodes.

A novel means is employed to transfer image data from a stationary flex cable to the rotating ring electrodes. Conducting balls provide electrical connections from points on an inner stationary cylinder to the ring electrodes on the outside of a rotating cylinder.

Relative to the first preferred embodiment, the fourth preferred embodiment is capable of higher speeds. An example is given whereby a color sheet with pixel resolution of sixteen pixels/$mm^2$ can be printed in approximately ten seconds. Also, the novel writing drum eliminates the need for an optical data link as required for the first preferred embodiment.

It is an advantage of the present invention that there are a small number of moving parts which can lead to reliable operation and low cost of manufacture.

It is another advantage that the print engine is compact in physical size and low in weight.

It is another advantage of the present invention that the print engine can print multiple colors with a single pass of the print medium past the imaging drum.

It is another advantage that color images can be printed on plain paper, and other untreated print media.

It is yet another advantage that an engine of the present invention has operational versatility such that both the pixel size and the color depth can be adjusted between prints, under computer or manual control, and such adjustments affect only the print algorithms which are controlled by the software.

It is another advantage of the present invention that it can be adapted to a wide variety of configurations including color and monochrome printers and copiers, wide-bed plotters, and miniaturized portable printers.

It is a further advantage of the present invention that the external information source provides print data in digital form, and the printer system enclosing the print engine can be connected to a network of computers via a local area network.

Other objects and advantages of the present invention will no doubt become apparent to one of ordinary skill in the art after having read the following detailed description of the preferred embodiments which are illustrated in the various drawing figures.

IN THE DRAWINGS

Table 1 is a summary of the programmable modes of the print engine of the first preferred embodiment with associated print parameters and formulas.

DETAILED DESCRIPTION OF THE PREFERRED EMBODIMENT

Figure 1:
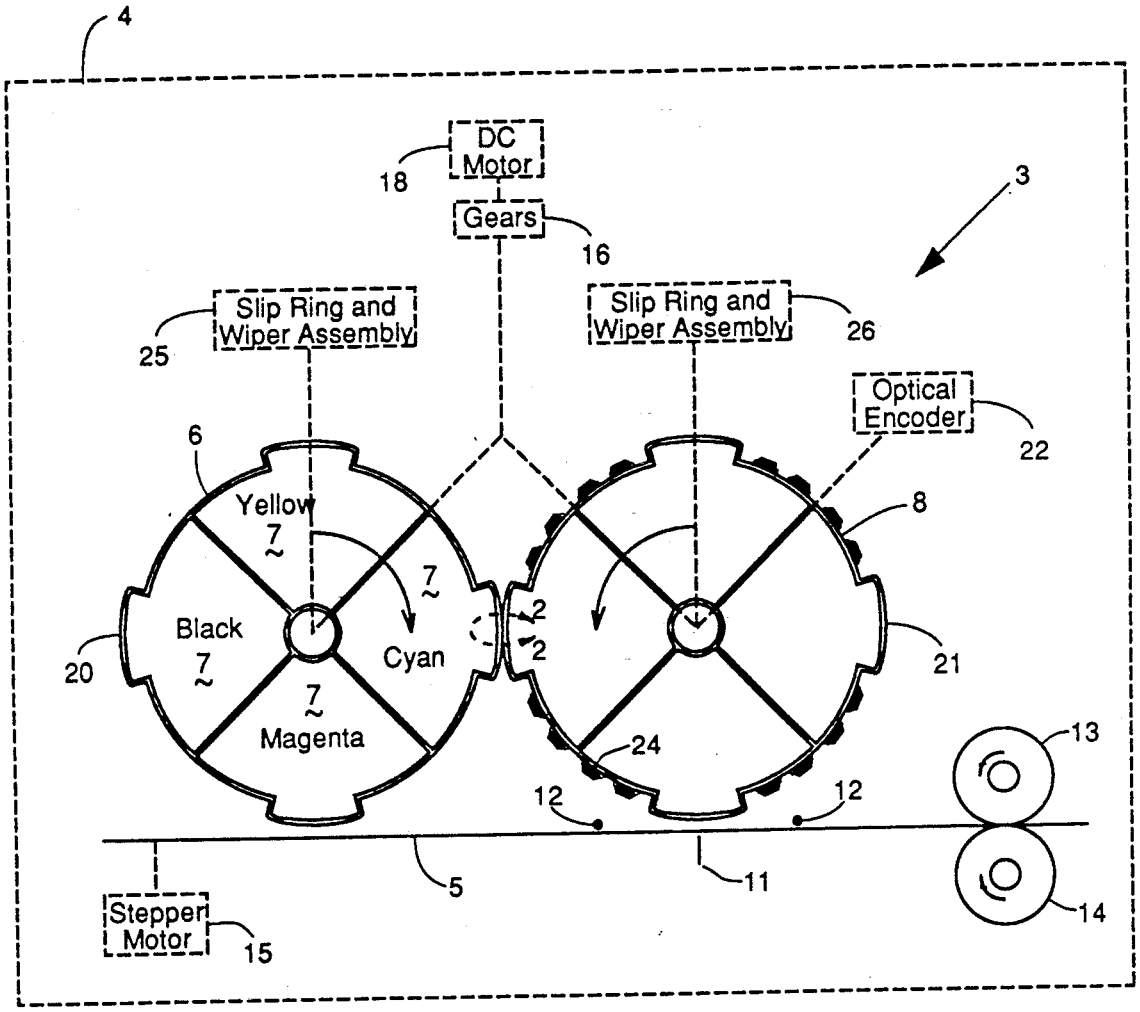
FIG. 1 is a schematic diagram of a preferred embodiment of an electrodielectric print engine of the present invention having a dual drum architecture.

FIG. 1 illustrates an electrodielectric print engine of the present invention and is referred to by the general reference numeral 3. The print engine 3 is implemented within a printer system 4 using a print media 5 of either individual cut sheets or continuous rolls. The engine 3 includes a toner drum 6 having four different compartments 7 for storing toner of a different color, an imaging drum 8, a blade electrode 11, ground wires 12, a fuser 13 and a roller 14.

The printer system 4 feeds the print medium 5 into the print engine 3, and ejects the finished printed product. The print engine 3 controls the detailed stepping of the print medium 5 during imaging via a stepper motor 15. The print medium 5 is an untreated receiving sheet. Binder material may be contained in the toner particles to permanently bond imaged toner to the print medium 5 at the fuser 13.

The toner drum 6 and the imaging drum 8 are locked in synchronous rotation by a system of gears 16, driven by a DC motor 18 operating at a fixed speed. The drum 6 has four toner support lobes 20 and the imaging drum 8 has four imaging lobes 21 which may also be referred to as writing heads. The lobes 20 and 21 are arranged such that each toner color (black, yellow, cyan, magenta) has a dedicated pair of lobes 20 and 21, i.e. one lobe 20 on the toner drum 6 and a corresponding imaging lobe 21 on the imaging drum 8. An optical encoder assembly 22 is attached to an end plate of the imaging drum 8 and provides an angle of rotation to a plurality of integrated driver circuits 24 which control the imaging functions and are located in the recessed areas between the lobes 21 of the imaging drum 8. The electrode driver circuits 24 may be implemented with CMOS circuits except for the output driver transistors which may be DMOS circuits capable of operating at higher output voltages.

A slip-ring and wiper assembly 25 is connected about and to the end of the toner drum 6. Similarly, a slip-ring and wiper assembly 26 is connected about and to the end of the imaging drum 8. After imaging, the toner is held to the corresponding lobe 21 of the imaging drum 8 against centrifugal forces by voltages applied to imaging electrodes in the lobes. The imaging drum then rotates until the imaged toner is positioned adjacent to the blade electrode 11. Then, the attractive imaging potentials are turned off. A high negative voltage pulse applied between the blade electrode 11 and the ground wires 12, pulls the toner off the surface of the imaging lobe 21 of the drum 8 and it deposits the toner on the print medium 5. Multiple rotations, e.g. up to three, of the imaging drum 8 can occur before the print medium 5 is stepped to the new pixel line position, depending on the pixel depth programmed for the current print. The size of the step depends on the programmed pixel size for the current print and is equal to the edge dimension of the pixel. The print medium 5 is stepped until the entire imaged area has passed through the fuser 13, whereupon the print is ejected, e.g. into an output cassette (not shown).

Figure 2:
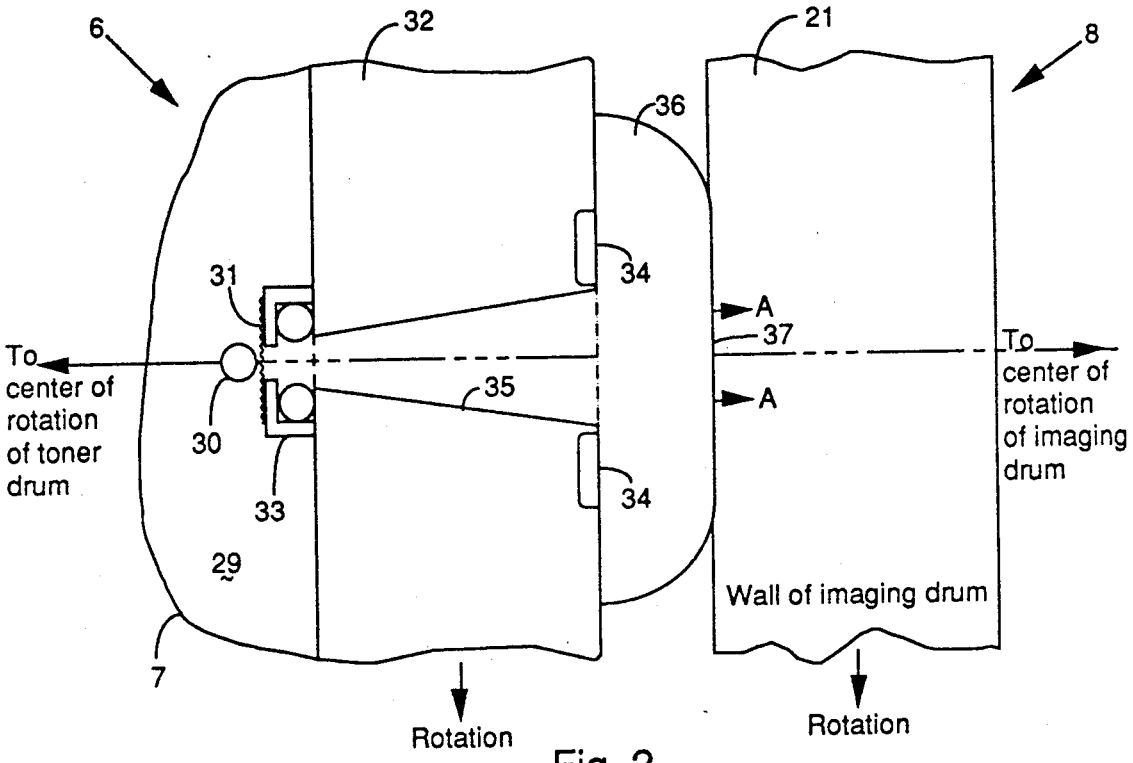
FIG. 2 is an exploded cross-sectional view of the section 2—2 of FIG. 1 showing the imaging geometries between the toner drum and imaging drum of FIG. 1.

The exploded cross-sectional view of FIG. 2 shows the close-up details of the imaging surfaces about two facing lobes. In operation, a quantity of toner 29 migrates from the compartment 7 under centrifugal forces toward a plurality of grid wires 30 which agitate the toner as it passes through a nylon mesh 31 which is bonded to a support bracket 33 attached to the inner surface of a peripheral wall 32 of the toner drum 6. The screen size of the nylon mesh 31 is fine enough such that when the toner drum 6 is not rotating, the toner 29 remains captured within the associated drum compartment 7 with no electrical potentials applied to embedded conductors 34 embedded within the outer wall 32 of the drum 6. This is necessary when the engine 3 is turned off. A mesh size of 20xx as used by artists for screen printing has been used for this purpose.

During printing operations, as toner 29 is used by the imaging process, additional toner moves through a toner feed hole 35 of the associated compartment 7 and forms a bump 36 of un-imaged toner at the outer surface of the wall 32 of the toner drum 6. The toner feed holes 35 are arranged in a line along the printing length, and the un-imaged toner forms a continuous bump of even height along the printing length because of lateral spreading of the toner 29 between feed holes 35, and the attractive force of the embedded conductors 34 which are continuous along the printing length. The embedded conductors 34 are connected to a single common positive voltage of approximately two hundred volts DC to hold the toner in position as the drum rotates. This voltage is supplied via the slip-ring and brush assembly 25. During the instant that the toner bump 36 is imaged, there is no relative motion between the toner and imaging drum 8 surfaces, such that the toner is in a stable position during imaging.

Figure 2A:
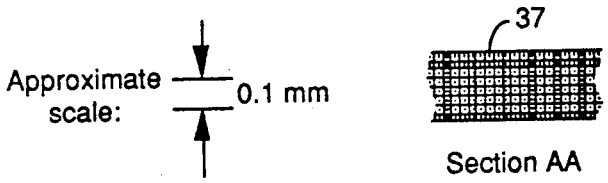
FIG. 2A is an enlarged view of a section of imaging electrodes about the outer surface of the wall of the imaging drum.
Figure 2B:
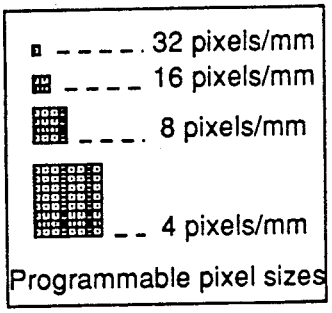
FIG. 2B illustrates programmable pixel sizes.
Figure 3:
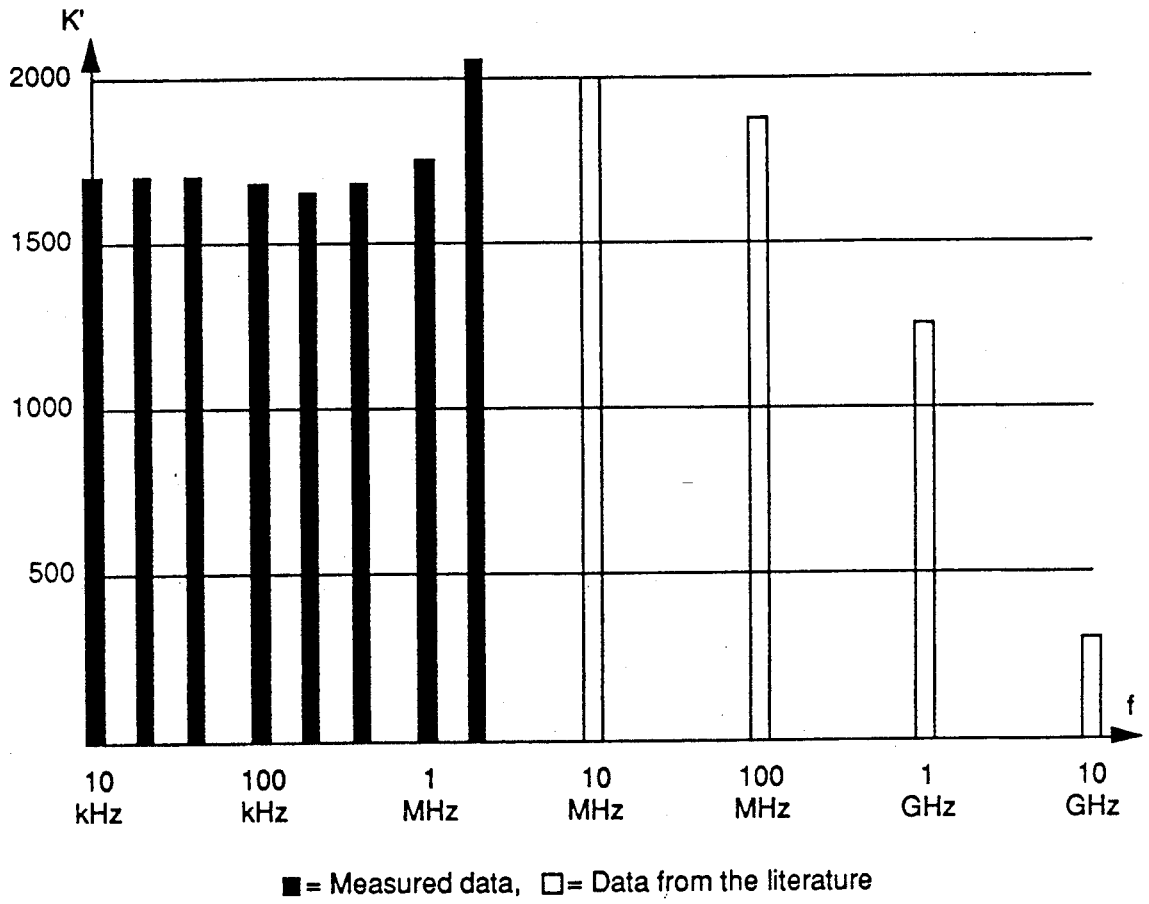
FIG. 3 is a graph of the relative dielectric constant versus frequency for pure $BaTiO_3$ in its bulk form.

FIG. 2A illustrates section AA of FIG. 2 to show the linear array of imaging electrodes 37 on the imaging lobes 21 of the imaging drum 8. The electrodes 37 are centered within a square conducting grid at ground potential and are electrically driven by DMOS driver transistors contained within the imaging circuits 24. Depending on the programmed pixel size, electrodes 37 are grouped into groups of 1, 4, 16 or 64 element groups to implement print resolutions of 32, 16, 8 and 4 pixels/mm respectively. FIG. 2B illustrates programmable pixel sizes. Each group is switched as a single electrical entity with the appropriate number of electrode drivers 24 operating in parallel. The rise time of the imaging potential is typically of the order of one microsecond. A toner material containing $BaTiO_3$ has a high dielectric constant at this frequency as shown in FIG. 3.

The toner material 29 preferrably contains primary particles of a ceramic powder, e.g. titanates of barium, strontium and calcium. The primary particles are attached to the periphery of a sphere of translucent materials including resin binder, pigments, and additives. Alternatively, the primary particles may first be encapsulated in pigment, then distributed at the periphery of a sphere containing binder and additives. Such composite toner particles have a high effective relative dielectric constant, typically greater than one hundred. This property allows strong imaging forces to be generated with relatively weak electric fields. The physical and electrical properties of barium titanate ceramic are attractive to printing applications. It may be processed into molded components or into a very fine powder, has a dielectric strength in the order of 300 V/mil; a volume resistivity in the order of $10^{10}$ ohms/centimeter, a density of 4.5 grams per cubic centimeter, very little water absorption and is of low cost. Ball milling may be employed to produce particles that are approximately spherical in shape with a maximum particle diameter of five microns and a median diameter of 1.5 microns, and this process is typically used prior to molding three dimensional components.

The imaging voltage at each electrode 37 or group of electrodes is programmed to one of four values, i.e. VCC1, VCC2, VCC3 or ground, depending on the amount of toner 29 of the current color required. A pixel depth of four is obtained for each toner color for a single rotation of the imaging drum 8. Depending on the pixel depth programmed and the corresponding number of image drum 8 rotations, four, eight or twelve levels of each toner color can be applied resulting in theoretical color combinations totalling 256, 4,096 and 20,736, respectively. After fusing, the distribution of primary particles within the matrix of translucent materials is preferrably a uniform distribution in order to achieve the highest perceived brightness of the printed image.

Figure 4:
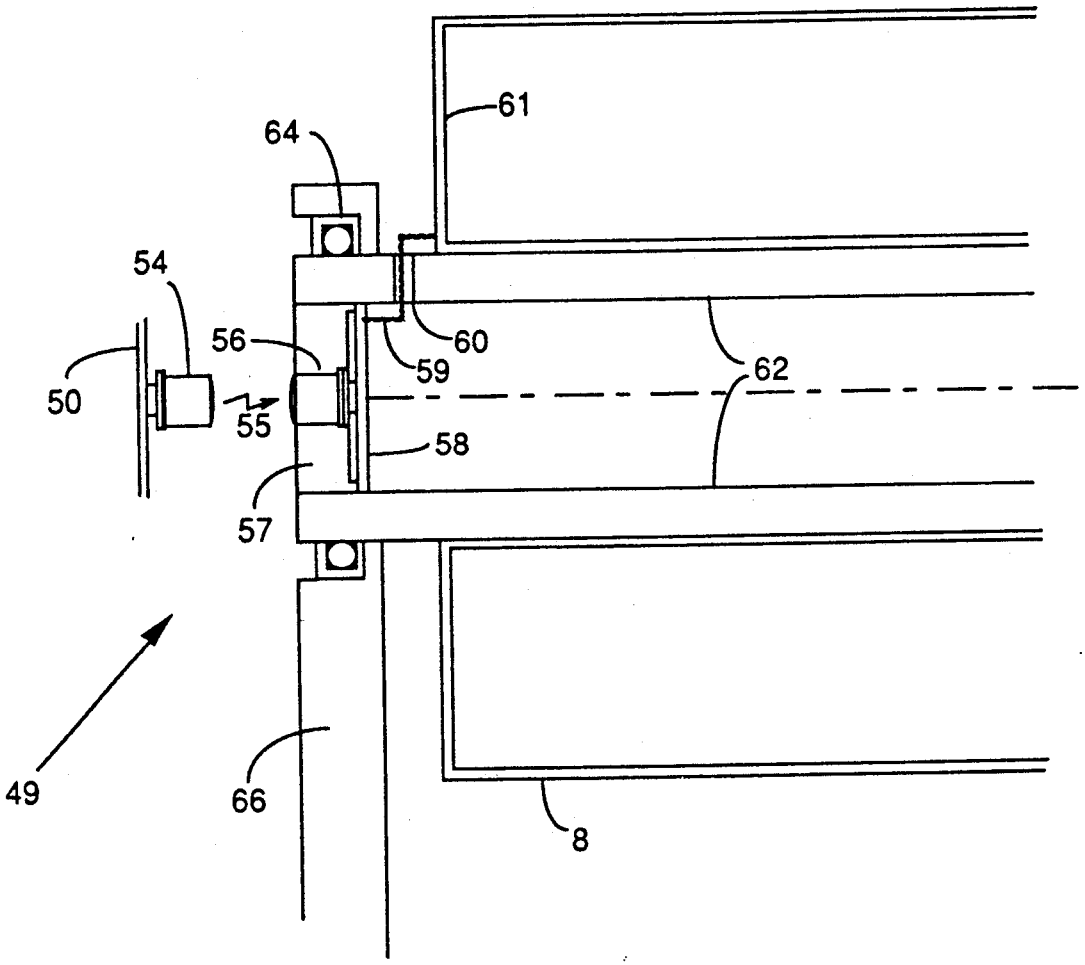
FIG. 4 is a detailed cross-sectional view of the optical data link assembly of the engine of FIG. 1.

FIG. 4 shows a close-up cross-sectional view of a portion of an optical data link assembly 49 connected to the imaging drum 8 and assembled about the axial end of drum 8. A fixed printed circuit board 50 supports an optical transmitter 54. Light energy 55 propagates across an air gap to an optical receiver 56, which is mounted to rotate with the imaging drum 8. The optical receiver 56 is positioned on the centerline axis of the imaging drum 8 by a spacer 57 and the received signal is fed to a rotating printed circuit board 58. A conductor pair 59 is connected to the board 58 and passes via feed-through hole 60 to circuit traces on an endplate 61 of the imaging drum 8. The imaging drum 8 has a hollow shaft 62, providing space to mount the optical receiver 56 and associated components. The shaft 62 rotates in a ball bearing assembly 64 which is mounted in a fixed bearing support wall 66.

Table 1 includes data load times per page for all the printer modes assuming a net serial data rate of ten million bits per second. This data rate is realized using common local area network standards such as Ethernet, and easily accomplished using emerging standards such as Fiber Distributed Data Interface, FDDI. Since the printing environment typically includes data distribution by local area networks, convenient and inexpensive ports to such networks are an important consideration for printer manufacturers. In addition, the imaging circuits that implement the print algorithms are designed to be interruptible without image degradation, and this leads to lower system costs by reducing print buffer memory requirements in the computing system and the printing system.

Figure 5:
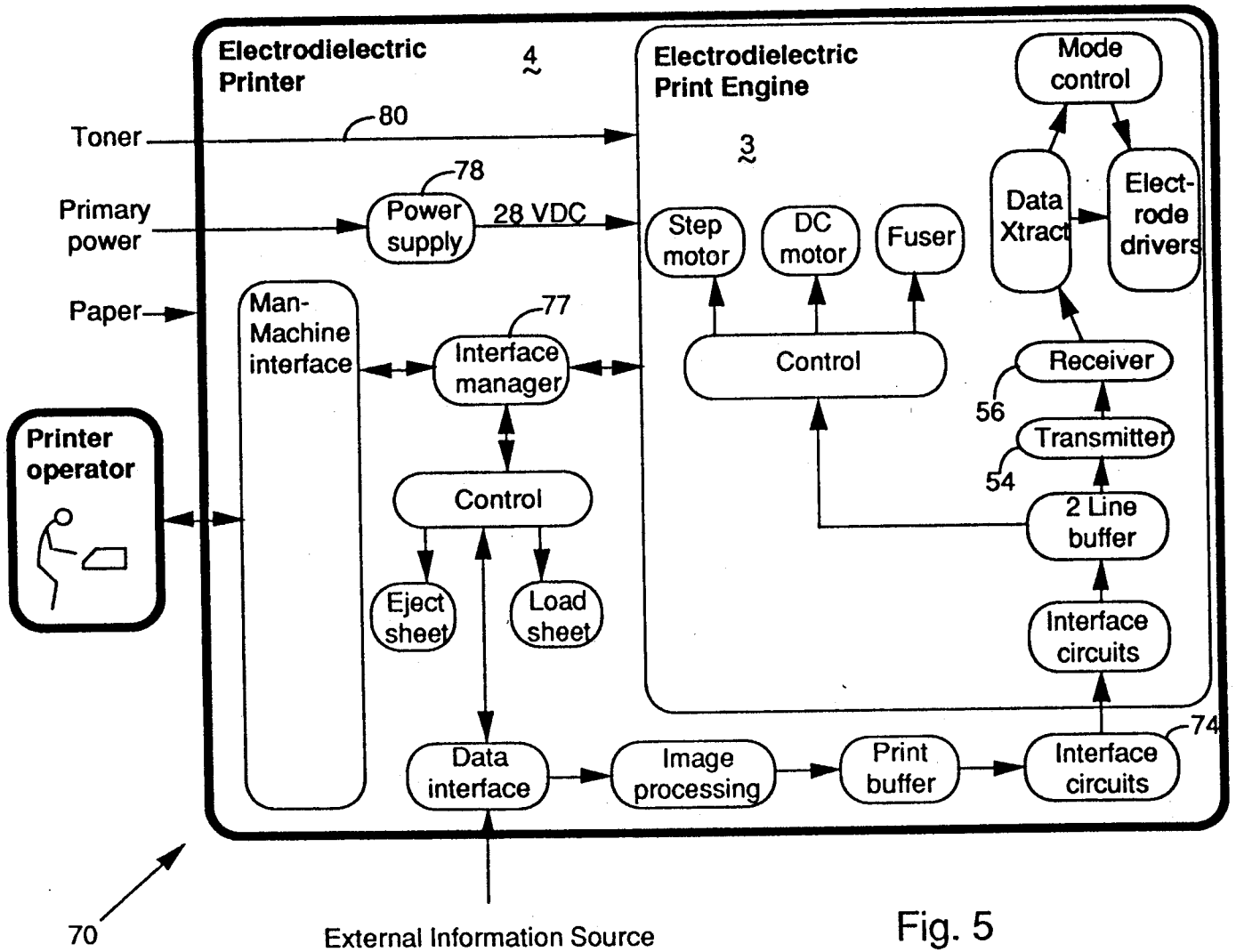
FIG. 5 is a functional block diagram of the printer engine enclosed within a host printer system.

FIG. 5 illustrates a functional block diagram 70 of a printing system enclosing the print engine 3. The diagram 70 includes a description of functional objects in the printer 4, including an interface to a human operator. Inputs to the print engine 3 are reduced to a minimum number of physical connections: high speed serial interface circuits 74; an input port conveying control signals from a man-machine interface 77, a single power supply 78 providing an input of 28 volts DC, and replacement toner cartridges 80. Access to replace toner cartridges 80 is provided by hinging an endplate of the toner drum 6 such that a spent cartridge 80 can be removed, and the replacement cartridge 80 inserted after removing a protective adhesive strip that covers the outer radius of the toner cylinder quadrant. The paper moving responsibilities are shared by the printer and the printer engine; the printer taking care of loading and ejecting the print medium, the print engine controlling paper movement via stepper motor 15 during imaging.

This separation of responsibilities provides maximum flexibility to the printer manufacture to provide custom paths for the print media; to potentially include cut sheet feeders, sorters, collators, and the like. Within the print engine 3, the control module supports the timing and control of a step motor, the DC motor that drives the drums, and the fuser. Additionally, the data interface circuits accept data and control information from the printer interface circuits 74 and load a buffer having two pixel lines of data. Control related information is sent to the control module. The 2-line buffer feeds data and control information to the transmitter 54 and receiver 56 of the optical data link to the rotating circuits which include a data extractor module, a mode control module, and electrode driver circuits.

Within the print engine 3, there are stationary and rotating circuits. Stationary circuits are implemented with a general purpose microprocessor and include controls for the step motor, DC motor and fuser. The print data stream can be interrupted at any time without degradation of image quality. This is accomplished by circuits that "look ahead" by one step of the stepper motor, and do not start to print a pixel line until the data for that line is ready. Preferrably, the stepper motor should be of a quality sufficient to position accurately in start/stop mode as well as continuous mode. The net result of this feature, together with bidirectional communication protocols between the information source and the printer, is substantially smaller print buffers in both the computing environment and the printer environment, leading to economies in memory costs at multiple levels.

Figure 6:
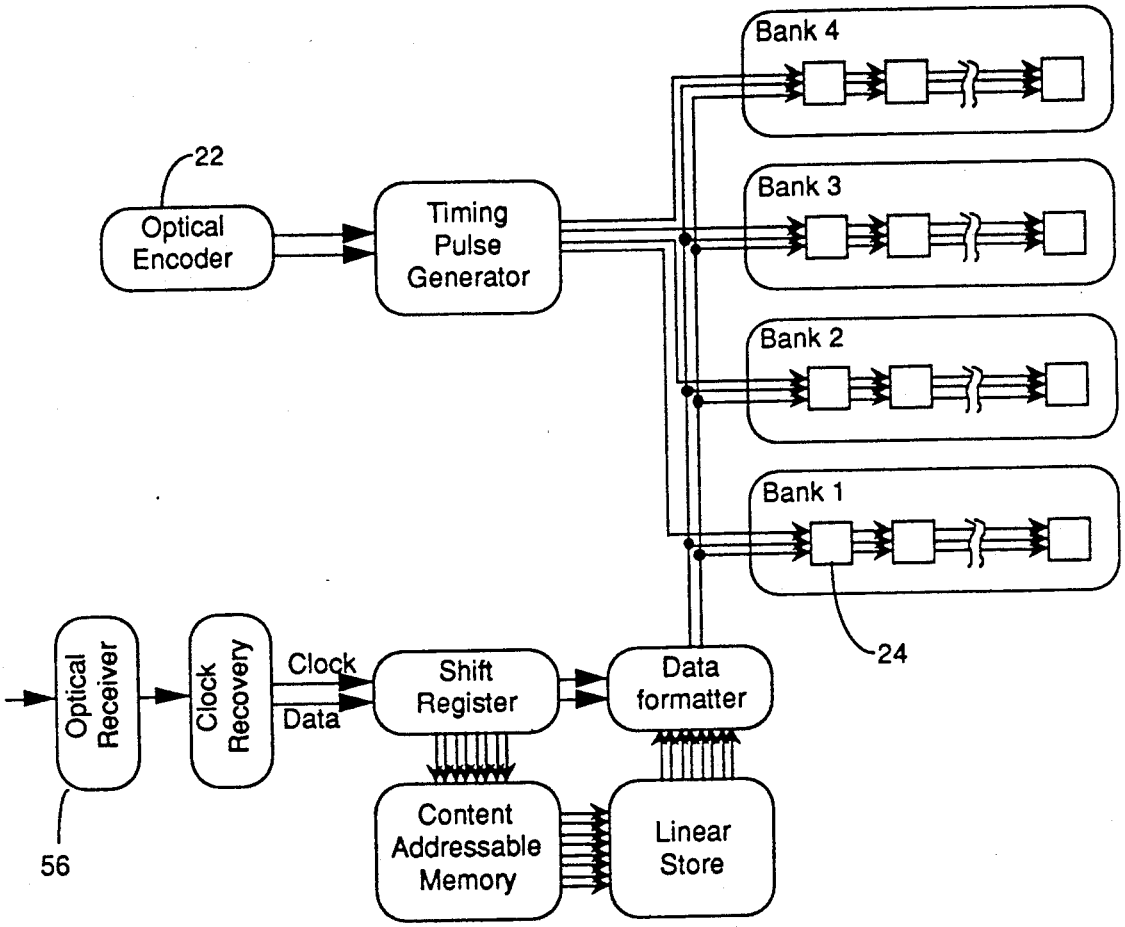
FIG. 6 is a functional block diagram of the rotating circuits contained on the imaging drum of FIG. 1.

The rotating electrode driver circuits carried by the imaging drum 8 are further defined in the functional block diagram of FIG. 6. The optical receiver converts the incoming light pulses to electrical signals. Clock recovery circuits generate both clock and data signals from the single serial input. The data stream contains both print data and control data such as print mode information, and passes into a shift register. The data and control information are separated, and the data information is formatted to drive the electrode driver integrated circuits 24. This is accomplished by using the combination of a content addressable memory to identify control versus data elements, and a linear store that contains micro instructions for the data formatter. In addition, the optical encoder assembly 22 feeds a timing pulse generator with angle information, such that correct timing pulses for imaging each color are provided to the electrode driver integrated circuits, which are arranged in banks, one bank for each color.

Figure 7:
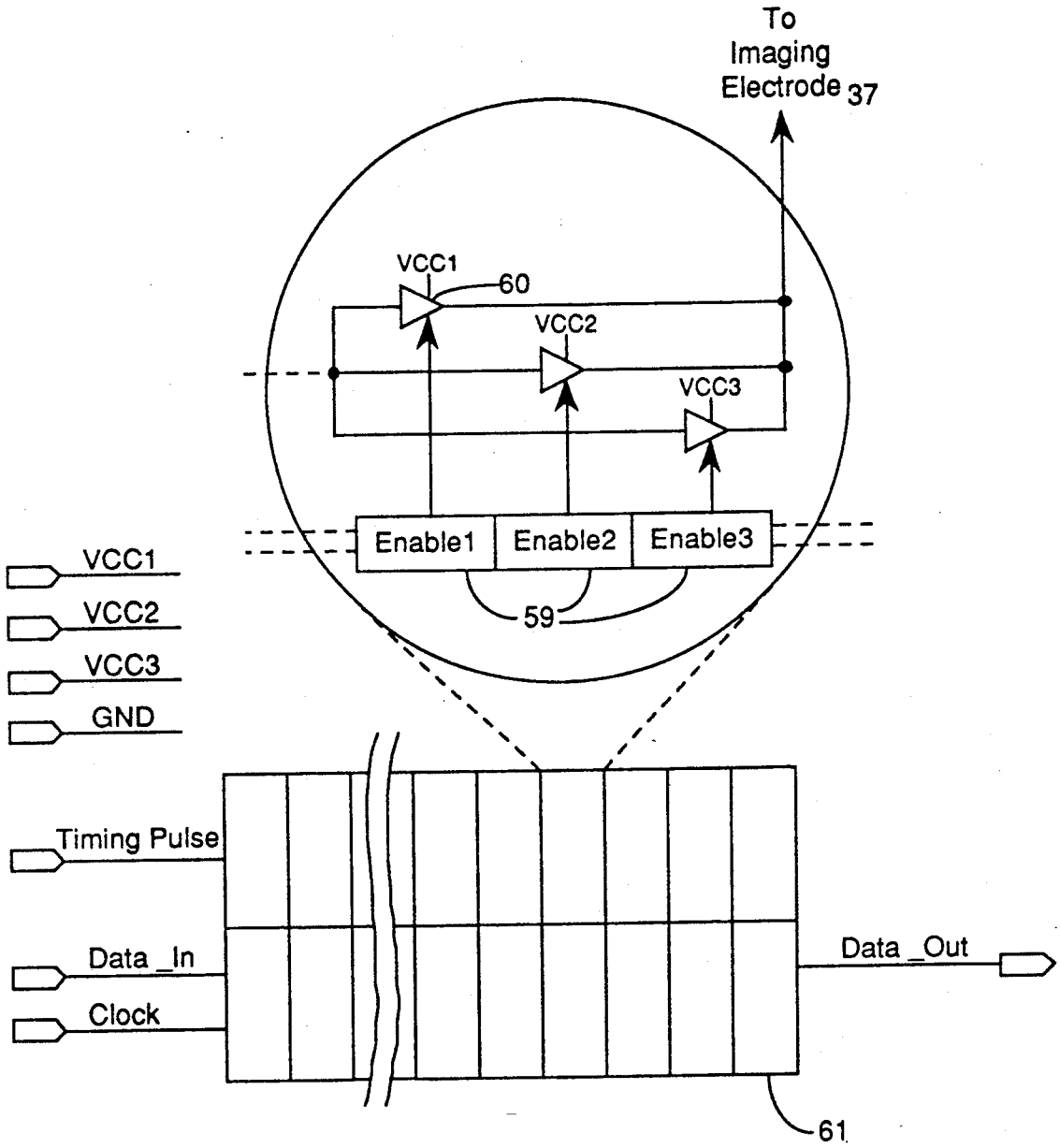
FIG. 7 is a functional block diagram of the electrode driver integrated circuit that is replicated many times on the imaging drum, including the details of the imaging electrode drivers.

Details of the electrode driver integrated circuits are contained in FIG. 7. Since these circuits are replicated several hundred times for a typical printer application, the logic is partitioned to be as simple as possible on the replicated circuits. Each minimum pixel position has three bits of information 59, provided by the data formatter, of FIG. 7, that control the pixel density via the three-state driver transistors 60. The three voltages VCC1, VCC2 and VCC3 provide three levels of toner attraction. The fourth level, GND, represents no toner attraction and is implied by the absence of any active enable bits in the shift register 61.

Referring again to Table 1, it shows a listing of programmable modes of the print engine for color, including black and white print applications. Relevant print parameters are included to allow calculation of print times and data load times for each combination of resolution and pixel density. The operational flexilibity outlined in Table 1 provides a printing resource that can be connected to multiple diverse users; configurable to provide service to a wide range of printing requests. Such requests may range from monochrome copying with forty-eight gray scale levels, to multi-color printing at approximately thirteen seconds per page, to sophisticated color printing with many thousands of selectable colors and very high print resolutions up to thirty-two pixels per millimeter for photograph quality color output. Additionally, with stable and accurate toner colors, and digital metering of the color components of an image, very high color accuracy produced by the print engine can result in faithful copies of digitized images. Also, print sizes are selectable between A and B size, or continuous roll.

Figure 8:
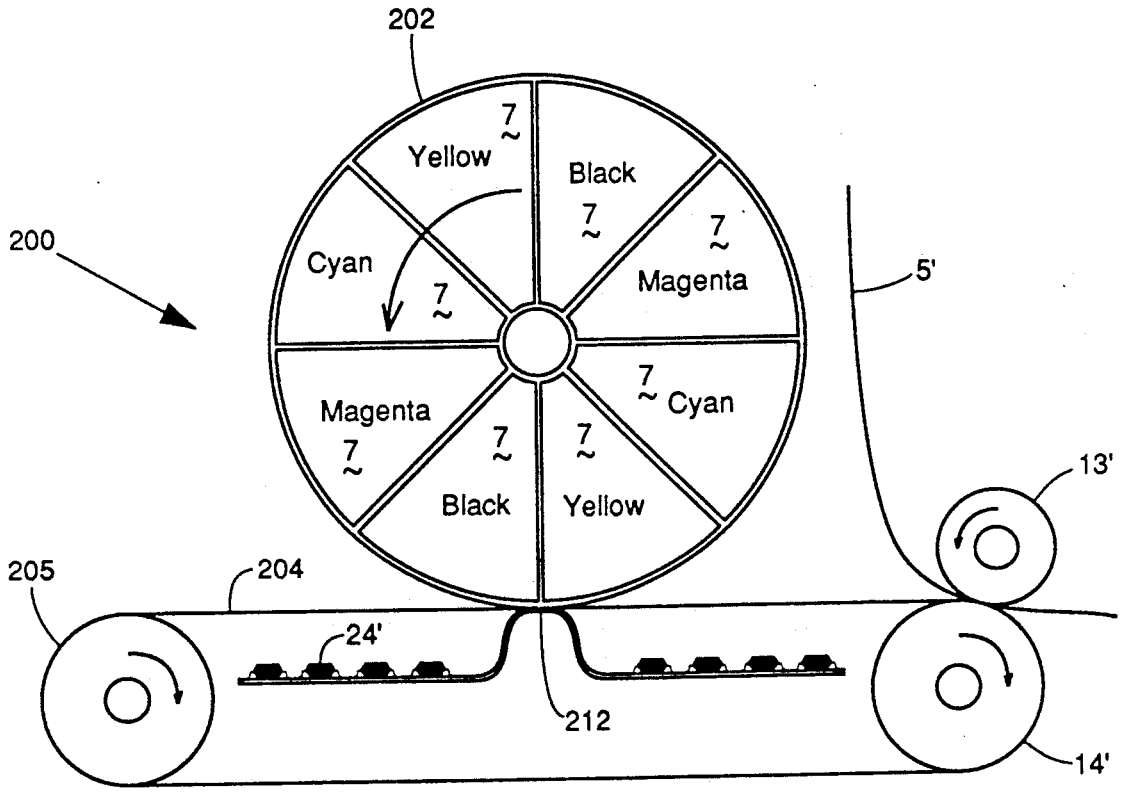
FIG. 8 is a schematic diagram of a second preferred embodiment of an electrodielectric print engine of the present invention having a toner drum plus transfer belt architecture.

FIG. 8 shows an alternative embodiment of an electrodielectric print engine of the present invention and is referred to by the general reference numeral 200. Those elements which are similar to those of the engine 3, carry the same reference numeral and are distinguished by a prime designation. The engine 200 includes a toner drum 202; a transfer belt 204 carried on a roller 205, the roller 14'; and integrated driver circuits 24' mounted on a molded circuit assembly. The operation of the toner drum 202 is similar to that of the toner drum 6 in system 3, except that a multiple of four toner compartments can be provided which will increase printing speed for a given rotational speed of the toner drum 202. In the system 200, eight toner compartments are included. A stationary writing head 212, similar to the imaging lobes 21 is provided. The writing head 212 is similar in operation to that of imaging lobes 21 of system 3 except that the imaging potentials to the head 212 must be stronger to be effective through the transfer belt 204 which tends to shunt the electric field developed at the writing head 212 imaging electrodes.

In operation, toner is transported on the transfer belt 204 to the fuser 13' which permanently bonds the toner to the surface of the print medium 5' in a manner similar to that implemented with system 3. The imaging circuits in the head 212, as in the imaging lobes 21, may be implemented with CMOS circuits driving DMOS high voltage drivers on monolithic silicon ICs. Relative to the system 3, system 200 has higher printing speed, a simpler data interface, and requires less mechanical precision. However, system 200 requires higher imaging voltages, has lower durability due to the thin transfer belt, and lower resolution due to the dielectric belt interposed between the imaging electrodes and the toner.

The belt 204 is manufactured from the thinnest possible material to limit the field spreading effects. Tedlar ® by DuPont, a polyvinyl fluoride film, is one material because of its strength and surface properties.

Figure 9:
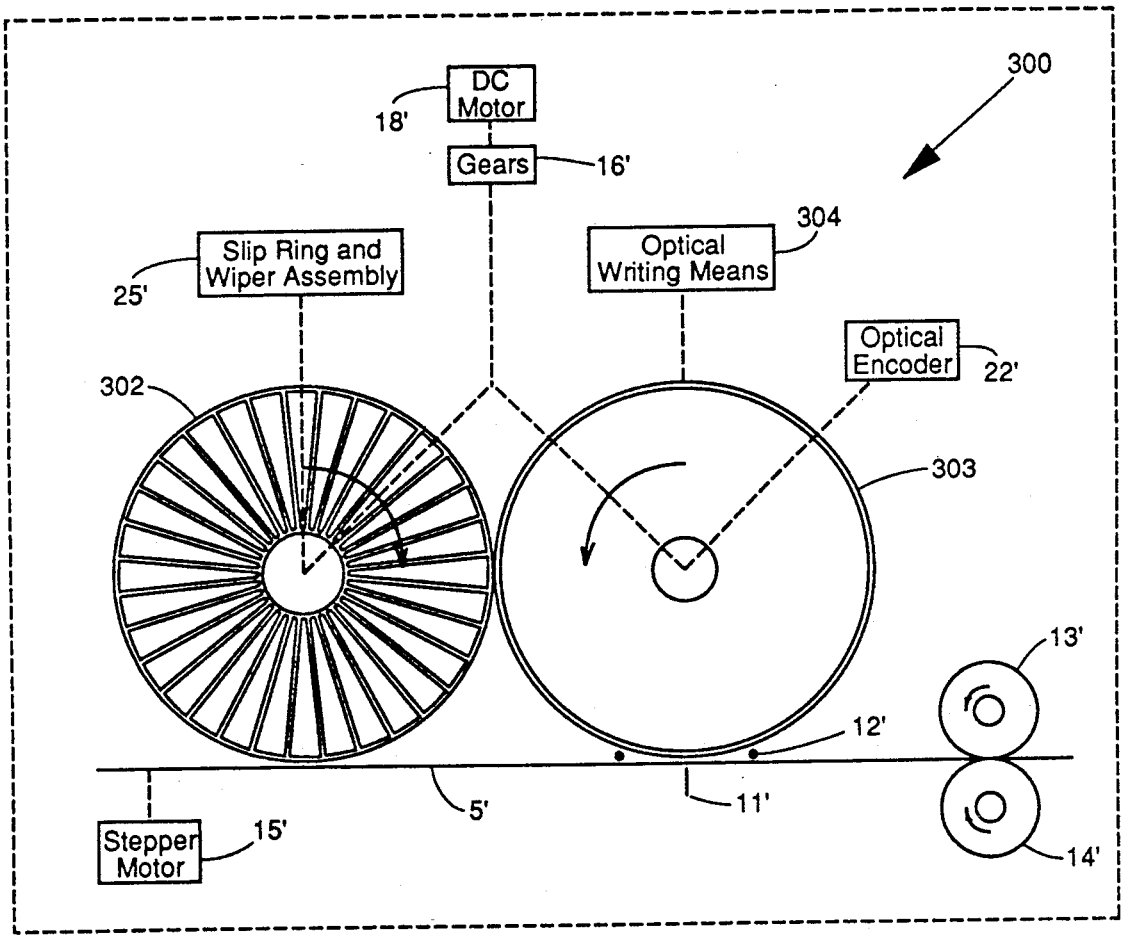
FIG. 9 is a schematic diagram of a third preferred embodiment of an electrodielectric print engine of the present invention having a conventional photoconductive drum plus optical writing means to generate the charge image prior to toning with high dielectric toner particles.

FIG. 9 shows another alternative embodiment of an electrodielectric print engine of the present invention and is referred to by the general reference numeral 300. Those elements which are similar to those of system 3, carry the same reference numeral and are distinguished by a prime designation. The engine 300 includes a toner drum 302, a charge receptor drum 303, and an optical writing means 304. The blade electrode 11', ground wires 12', fuser 13' and roller 14' are similar to system 3. The toner drum 302 is similar to that of the toner drum 6 in system 3, except that a large number of toner compartments is provided during each rotation, for example thirty-two. The charge receptor drum 303 is a conventional photoconductive drum that has been used for many years in the copier industry. It is written by an optical writing means 304 as is known in the industry. The format of the charge image on the charge receptor drum 303 is not conventional. Each pixel line of data is divided into its component colors, and a line of data is written on the drum for each color. There is a blank space between each line. Imaging occurs because the high dielectric toner particles are attracted to the charges on the charge receptor drum. After the toner is transferred to the imaging drum which is in this case the charge receptor drum, the operation of the print engine is the same as for system 3.

Figure 10:
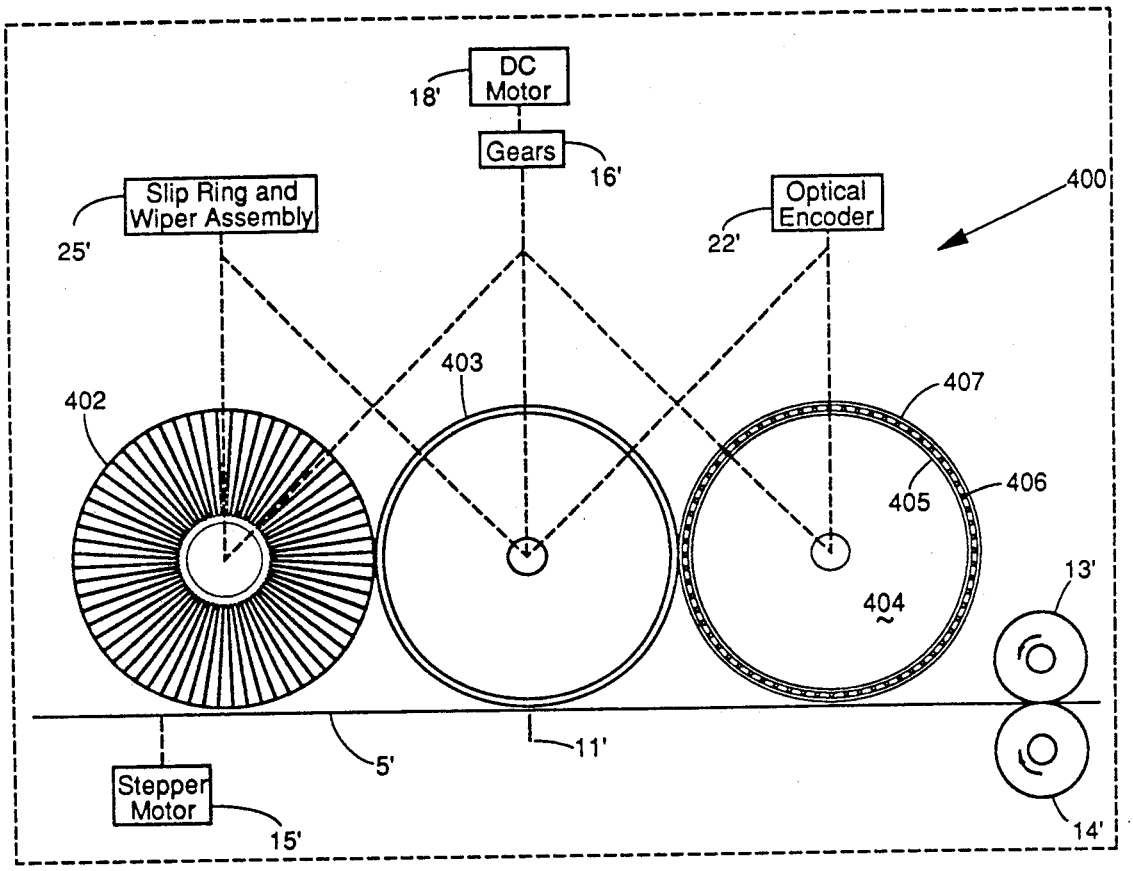
FIG. 10 is a schematic diagram of a fourth preferred embodiment of an electrodielectric print engine of the present invention having a charge receptor drum constructed from $BaTiO_3$ or other high dielectric material and a writing drum assembly for writing the image to the charge receptor drum.

FIG. 10 shows another alternative embodiment of an electrodielectric print engine of the present invention and is referred to by the general reference number 400. Those elements which are similar to those of the engine 3, carry the same reference numeral and are distinguished by a prime designation. The engine 400 includes a toner drum 402; a charge receptor drum 403; and a writing drum assembly 404. The charge receptor drum 403 is similar to the drum 303 of system 300 except it is built on a ceramic substrate material such as $BaTiO_3$ with high dielectric constant. The toner drum 402 is similar to the toner drum 6 of system 3 except that it has a large number of toner compartments, for example sixty-four.

Figures 11, 11A:
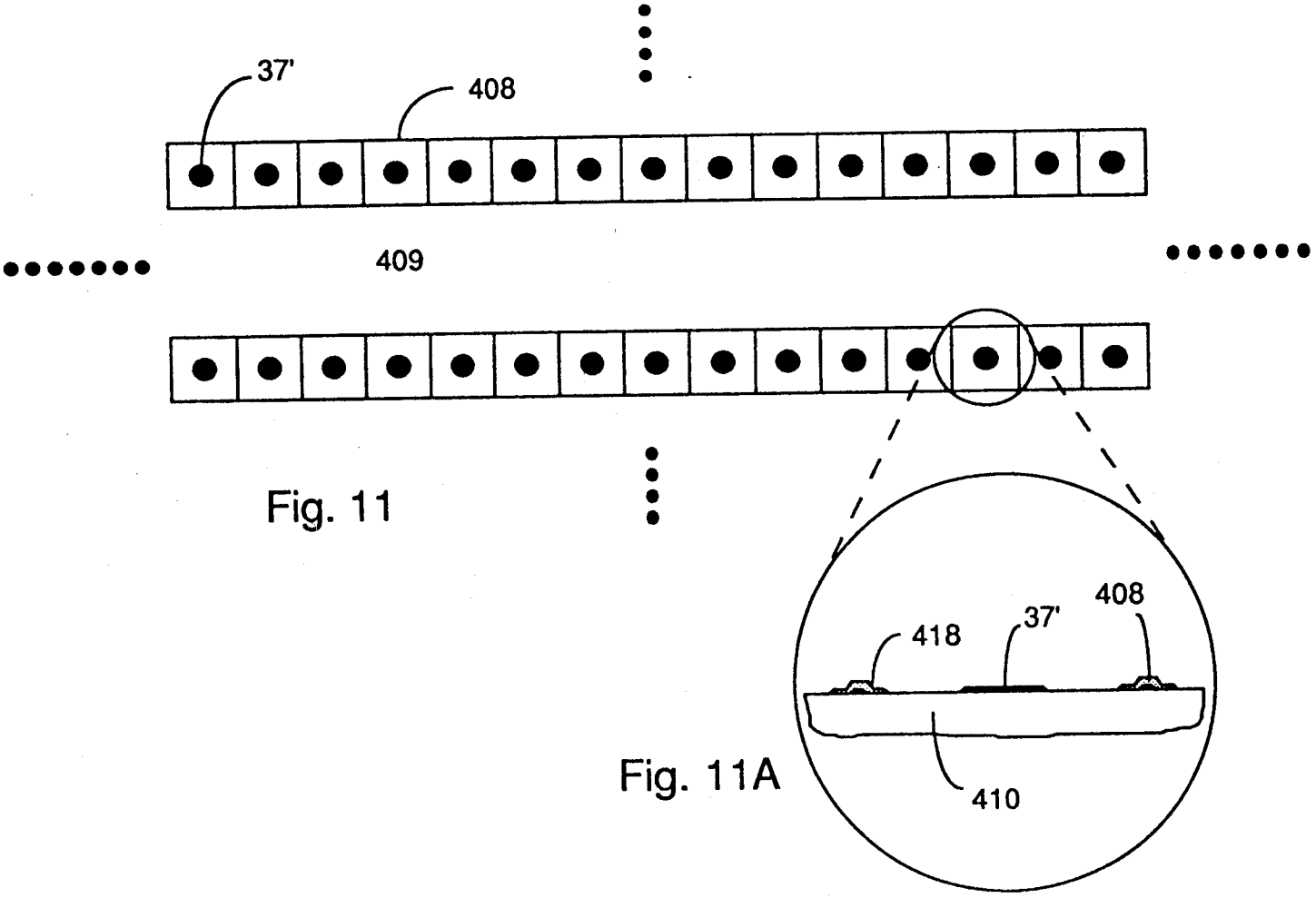
FIG. 11 is a close-up view of a section of the imaging electrodes on the outer surface of the charge receptor drum of FIG. 10.
FIG. 11A shows the detail of conducting and insulating thin films that comprise a pair of electrodes from FIG. 11.

Details of imaging electrodes provided on the surface of the charge receptor drum 403 are shown in FIG. 11. The electrodes extend the length of the drum with a row of electrodes for each toner color. The center electrodes 37' are contained within a square grid 408 which is at ground potential. Each row of electrodes is separated by a blank space 409. FIG. 11A shows that the grid conductors 408 are covered with an insulating thin film 418 so that the electrode pairs will not be shorted when contacted with conductors on the writing drum assembly 404. The thin film conductors are built on a high dielectric substrate material 410 which produces a significant capacitance between electrode pairs, even in the planar configuration.

By way of example, FIG. 10 is drawn with sixty-four toner compartments in toner drum 402, sixty-four rows of electrodes on the surface of charge receptor drum 403, and sixty-four conducting balls in each circumferential ring of balls contained in writing drum assembly 404. This provides a simple case where all three drums are rotating at the same speed, locked in synchronism by the gears 16'. Each drum has an outer diameter of 80 mm and the conducting balls have a diameter of 1.25 mm in the example.

Figure 12:
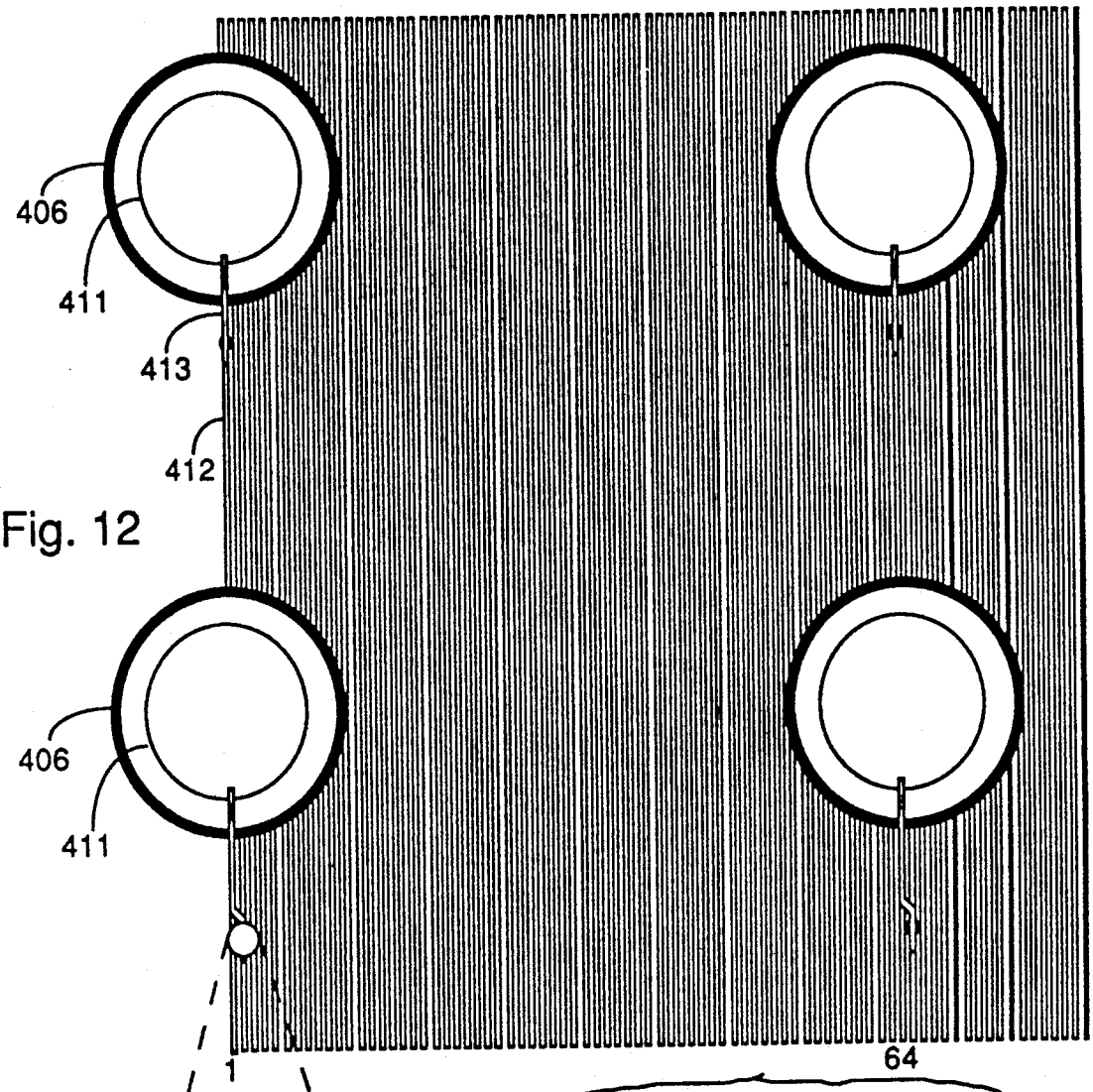
FIG. 12 shows the detail of ring electrodes, contact pads, and conducting balls of a portion of the inner surface of the outer cylinder of the writing drum assembly.
Figure 12A:
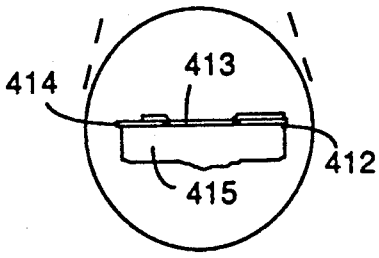
FIG. 12A shows a detailed side view of conducting and insulating films at a contact point of a ring electrode of FIG. 12.

FIG. 12 shows an outline of the conducting balls 406 positioned over conducting pads 411. Each pad is connected to a unique ring electrode which encompasses the circumference of the drum. The figure shown is for the inner surface of the outer cylinder 406 of writing drum assembly 404. The outer cylinder 406 rotates in synchronism with the charge receptor drum 403, while the inner cylinder 405 is stationary and is connected via conducting posts or pads to a flex circuit supplying the print data (not shown), with one post corresponding to each conducting pad 411. The conducting balls are sized such that they roll without sliding at either the outer cylinder 407 or the inner cylinder 405. FIG. 12A is a side view of the electrical connection between each conducting pad 411 and corresponding ring electrode 412. The optical encoder 22' provides angle information for the drive electronics. By this means the driver circuits are synchronized to switch while the line of contact between the charge receptor drum 403 and the outer writing cylinder 407 is at the blank space 409 between lines of electrodes. At each of the sixty-four discrete angles when the conducting balls 406 are centered on the conducting pads 411, a different address map exists between the conducting pads 411 and the ring electrodes 412. Each angle increment causes a one bit shift in the mapping. This is easily compensated in the driver circuits which use the angle information to shift the data in correct correspondence with the ring electrodes.

FIG. 12, as drawn, assumes a resolution of sixteen pixels/mm. This requires sixteen ring electrodes per millimeter at the outer circumference of writing cylinder 407. Feedthroughs (not shown) connect matching ring electrodes at the outer and inner surface of writing cylinder 407. Since there are sixty-four conducting balls per plane perpendicular to the drum assembly 404, there can be sixty-four ring electrodes between adjacent conducting balls in the longitudinal direction. This corresponds to a center-to-center spacing between conducting balls of 4 mm in this direction. In the circumferential direction, the center-to-center spacing is pi ($\pi$) times the diameter or 3.93 mm in order that no slippage occurs during rotation of the outer cylinder 407 past the stationary inner cylinder 405.

Figure 12B:
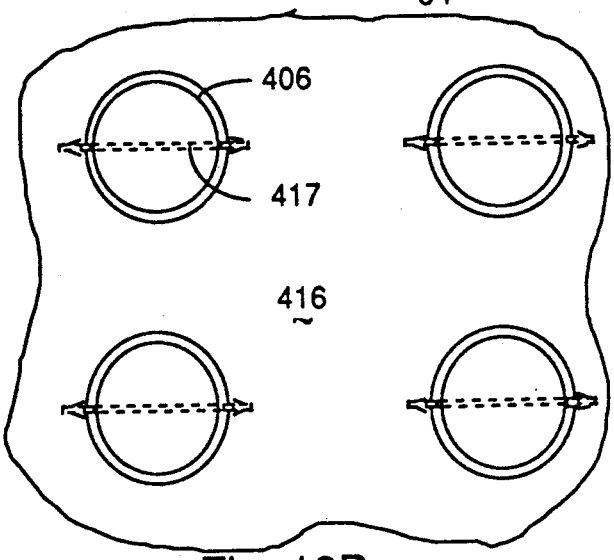
FIG. 12B shows the detail of how the conducting balls of FIG. 12 rotate on spring loaded pins held within a cylinder containing the conducting balls.

The conducting balls are held in a cylinder with a wall thickness less than the ball diameter. FIG. 12B shows the cylinder 416 and the conducting balls 406 held by spring mounted pins 417.

Preferrably, the conducting balls 406 have some resilience and can be slightly deformed during operation such that, by minor shape adjustments, imperfections in the geometries of the interfacing mechanical components can be tolerated. This is also important at the line contact between the charge receptor drum 403 and the outer writing cylinder 407. Since the charge receptor drum 403 is molded from a hard ceramic material, some compliance must be provided at the surface of writing cylinder 407.

The advantage of this writing method is that high speed operation can occur at high printing resolutions and yet the positional tolerance of the balls is much greater than the distance between ring electrodes which matches the print resolution. A positive engagement between the writing drum assembly 404 and the charge receptor drum 403 is required to maintain longitudinal alignment between the two drums. Also, there is no need for an optical data link to provide data transfer between stationary and rotating components; this function is provided by the conducting balls.

For the example given, each of the three drums would rotate at 1200 rpm in order to print an A-size sheet in ten seconds. With four programmable imaging voltages for each of four colors, a palette of 256 colors would be provided. The pulse time per imaging cycle would be approximately 100 microseconds which is easily achieved using modern integrated circuits. The toner material maintains a high dielectric constant at these switching speeds as shown in FIG. 3.

Although the present invention has been described in terms of the presently preferred embodiments, it is to be understood that such disclosure is not to be interpreted as limiting. Various alterations and modifications will no doubt become apparent to one skilled in the art after having read the above disclosure. Accordingly, it is intended that the appended claims be interpreted as covering all alterations and modifications as fall within the true spirit and scope of the invention.

I claim:

1. A color printer system comprising:

a toner drum having a plurality of toner compartments circumferentially spaced about the drum and allowing travel of toner particles in a radial direction, said toner compartments having a toner containing $BaTiO_3$;

an imaging medium having a multiple of imaging electrodes arranged in a pixel format, said electrodes being connected to logic means for controlling the print pattern of said electrodes, the imaging medium being movable relative to the toner drum and having a surface about said electrodes for receiving toner emitted from the toner drum, arranging the toner in a programmed format and transferring the arranged toner to the surface of a transfer means;

means for transferring said formatted toner to a print medium; and fuser means for fusing said formatted toner to said print medium.

2. The color printer of claim 1 further including, means for including a binding material in the formatted toner prior to fusing said formatted toner to said print medium.

3. The color printer of claim 2 wherein, the toner drum has at least four toner compartments.

4. The color printer of claim 3 wherein, the number of toner compartments equals a multiple of four.

5. The color printer of claim 1 wherein, the toner drum includes a grid of wires with associated voltages arranged to agitate the toner and a feed aperture extending from each compartment to the exterior surface of the toner drum to permit toner to transverse from the associated compartment to said exterior.

6. The color printer of claim 5 further including, electrodes mounted about the intersection of each aperture and said exterior, said electrodes being connected to an electrical potential source whereby emitted toner may be induced to adhere to the surface of the toner drum about said aperture.

7. The color printer of claim 6 wherein, said electrodes are connected to control means for controlling the potential on the electrodes, whereby transfer of the emitted toner from the surface of the toner drum to the imaging medium may be controlled responsive to the potential on said electrodes.

8. The printer of claim 1 wherein, the toner drum has at least four toner compartments with each compartment having said toner and of a differing color selected from the group of black, yellow, cyan and magenta.

9. The printer of claim 1 wherein, the imaging medium includes a charge receptor drum with an optical writing means extending to said electrodes; and said toner particles have a high dielectric constant.

10. The printer of claim 9 wherein, said electrodes of the imaging medium are in the form of a circumferential pattern of rows across the imaging medium; and the format of the charge image on said photoconductive drum includes pixel lines of data with each pixel line of data divided into component colors and for each color there is a pixel line of data.

11. The printer of claim 10 wherein, said charge receptor drum is comprised of barium titanate.

12. The printer of claim 11 further including, a writing drum assembly connected to encoder means and having rotating conductive elements embodied therein.

13. The printer of claim 12 wherein, said conductive elements are in the form of a cylindrical array of conductive balls, held within inner and outer cylinders of the writing drum assembly.

14. The printer of claim 13 wherein, each of said balls can be positioned between conductive pads to perform the write function for the image data.

15. The printer of claim 14 wherein, each of said balls is positioned within a cylinder, and retaining means retains each of said balls in place in said cylinder.

16. The printer of claim 15 wherein, said inner cylinder of the writing drum assembly is stationary while said outer cylinder rotates in synchronism with said charge receptor drum.

17. A color printer system comprising:

a toner drum having a plurality of toner compartments circumferentially spaced about the drum and allowing travel of toner particles in a radial direction, the toner drum including a grid of wires with associated voltages arranged to agitate the toner and a feed aperture extending from each compartment to the exterior surface of the toner drum to permit toner to transverse from the associated compartment to said exterior;

an imaging medium having a multiple of imaging electrodes arranged in a pixel format, said electrodes being connected to logic means for controlling the print pattern of said electrodes, the imaging medium being movable relative to the toner drum and having a surface about said electrodes for receiving toner emitted from the toner drum, arranging the toner in a programmed format and transferring the arranged toner to the surface of a transfer means, the image medium including an imaging drum having a plurality of lobes with said imaging electrodes located about the surface of the lobes, and with the axis of rotation of said imaging drum being parallel with the axis of rotation of the toner drum;

drive means for driving the toner drum and imaging drum in synchronism with the axis of the feed aperture intersecting with the imaging electrodes at the corresponding points of tangency of the toner drum and imaging drum;

means for transferring said formatted toner to a print medium; and fuser means for fusing said formatted toner to said print medium.

18. The color printer of claim 17 wherein, the toner drum has a lobe at each compartment and the imaging drum has a corresponding number of lobes;

the toner drum being rotatable in a direction opposite to that of the imaging drum; and the toner drum and imaging drums being positioned such that they rotate relative to each other with the face of a lobe of each directly facing the face of a lobe of the other at the point wherein the surfaces are closest to each other.

19. The color printer of claim 18 wherein, the toner drum includes four equally spaced lobes.

20. The color printer of claim 19 wherein, the toner drum includes four compartments of substantially equal size with each compartment including a toner of a different color.

21. The color printer of claim 20 further including, means for pulling imaged toner from the surface of lobes of the imaging drum and onto a print medium.

22. The color printer of claim 20 further including, electrostatic means for pulling imaged toner from the surface lobes of the imaging drum and onto a print medium.

23. The color printer of claim 22 further including, fusion means for fusing said deflected image toner to said print medium.

24. The printer of claim 23 further including, screen means within each compartment about each feed aperture to interfere with travel of toner through said associated aperture.

25. The printer of claim 24 wherein, the toner drum has at least four toner compartments with each compartment having toner of a differing color selected from the group of black, yellow, cyan and magenta.

26. The printer of claim 25 wherein, said toner has an effective relative dielectric constant of at least 100.

27. The printer of claim 26 wherein, said toner includes $BaTiO_3$.

28. A color printer system comprising:

a toner drum having a plurality of toner compartments circumferentially spaced about the drum and allowing travel of toner particles containing $BaTiO_3$ in a radial direction;

an imaging medium having a multiple of imaging electrodes arranged in a pixel format, said electrodes being connected to logic means for controlling the print pattern of said electrodes, the imaging medium being movable relative to the toner drum and having a surface about said electrodes for receiving toner emitted from the toner drum, arranging the toner in a programmed format and transferring the arranged toner to the surface of a transfer means, the imaging medium including a writing head carrying said imaging electrodes and positioned immediately adjacent to the peripheral surface of the toner drum and a transfer belt movable over said head and intermediate to the toner drum, said transfer belt for receiving said arranged toner;

means for transferring said formatted toner to a print medium; and fuser means for fusing said formatted toner to said print medium.

29. The printer of claim 28 wherein, the toner drum has at least four toner compartments, a feed aperture extending from each compartment to the exterior surface of the toner drum to permit toner to transverse from the associated compartment to said exterior, electrodes mounted about the intersection of each aperture and said exterior, said electrodes being connected to an electrical potential source whereby emitted toner may be charged to adhere to the surface of the toner drum about said aperture, said electrodes being connected to control means for controlling the potential on the electrodes such that transfer of the emitted toner from the surface of the toner drum to the imaging medium may be controlled responsive to the potential on said electrodes.

30. A printing process comprising the steps of:

storing toner of a first color and containing $BaTiO_3$ in a first movable toner compartment;

moving said first toner compartment in a first path having a position interfacing with a writing head means having a writing head with imaging electrodes in a programmable pixel format;

electrically exciting said imaging electrodes in a desired format to create an electrostatic pattern about the writing head means consistent with a desired image to be printed, thereby attracting imaged toner from said toner compartment to the face of said excited imaging electrodes of said writing head;

transferring the imaged toner from the face of said writing head to a print medium; and fusing said transferred imaged toner to said print medium.

31. The printing process of claim 30 further including, storing toner of a second color in a second movable toner compartment;

moving said first and second toner compartments to successively interface with said writing head means, said movement being in programmed manner depending on a desired print color; and varying the electrical excitation to said imaging electrodes dependent upon the quantity of each toner color to be released to said writing head means.

32. The printing process of claim 31 wherein, said toner compartments are within a rotatable toner drum;

dispensing said toner under influence of centrifugal forces through an exterior compartmental opening within each toner compartment as the drum rotates and interfaces, in said first path with said writing head; and controlling application of an electrical charge about said exterior compartmental opening to control adherence of the dispensed toner to the exterior surface of said toner drum about said opening; and releasing said electrical charges as said writing head means interfaces with said adhered toner.

33. A printing process comprising the steps of:

storing toner of a first color in a first movable toner compartment within a rotatable drum;

storing toner of a second color in a second movable toner compartment within said rotatable toner drum;

moving said first and second toner compartments in a first path having a position interfacing with a writing head means having a writing head with imaging electrodes in a programmable pixel format and to successively interface with said writing head means, said movement being in programmed manner depending on a desired print color;

dispensing said toner under influence of centrifugal forces through an exterior compartmental opening within each toner compartment as the drum rotates and interfaces, in said first path with said writing head;

controlling application of an electrical charge about said exterior compartmental opening to control adherence of the dispensed toner to the exterior surface of said toner drum about said opening;

releasing said electrical charges as said writing head means interfaces with said adhered toner;

said writing head means including a rotating imaging drum with a plurality of said writing heads circumferentially spaced about said imaging drum;

electrically exciting said imaging electrodes in a desired format to create an electrostatic pattern about the writing head means consistent with a desired image to be printed, thereby, attracting imaged toner from said toner compartment to the face of said excited imaging electrodes of said writing head, and varying the electrical excitation to said imaging electrodes depending upon the quantity of each toner color to be released to said writing head means;

transferring the imaged toner from the face of said writing head to a print medium; and fusing said transferred imaged toner to said print medium.

34. The printing process of claim 33 wherein, the toner drum and the imaging drum are rotated in opposite directions such that at the interfacing position the relative velocity is minimal.

35. The printing process of claim 34 wherein, the toner drum includes a multiple of four compartments;

storing within each compartment a supply of toner of one of four colors;

evenly radially positioning the compartmental openings about the exterior peripheral surface of said toner drum;

the imaging drum includes a multiple of four writing heads with each head being designated for a particular one of said colors;

controlling release of excitation to said imaging electrodes to transfer the imaged toner from the face of said writing head at a select release location in the travel path of said imaging drum; and interfacing an electrostatic transfer means with said imaging drum at said select release location to assist removal of the imaged toner.

* * * * *

UNITED STATES PATENT AND TRADEMARK OFFICE

CERTIFICATE OF CORRECTION

PATENT NO. : 5,030,976

DATED : July 9, 1991

INVENTOR(S) : Peter C. Salmon

It is certified that error appears in the above-identified patent and that said Letters Patent is hereby corrected as shown below:

After sheet 12 of 12 of the Drawings add TABLE 1 as shown on the attached page.

Signed and Sealed this

Nineteenth Day of January, 1993

*Attest:*

DOUGLAS B. COMER

*Attesting Officer*

*Acting Commissioner of Patents and Trademarks*

| Mode | Resolution | | Print Time per page(1) seconds | | Color Parameters | | | Black & White Parameters | | |
|---|---|---|---|---|---|---|---|---|---|---|
| | Pixels per mm | Pixels per inch | Color | Black and White | Colors per Pixel(3) | Drum rotations per Pixel | Data Load Time per Page(2) secs | Grey Levels per Pixel(3) | Drum rotations per Pixel | Data Load Time per Page(2) secs |
| 1 | 4 | 102 | 13.3 | 3.3 | 16 | 1 | 0.32 | 4 | 0.25 | 0.16 |
| 2 | 4 | 102 | 13.3 | 13.3 | 256 | 1 | 0.64 | 16 | 1 | 0.32 |
| 3 | 4 | 102 | 26.6 | 26.6 | 4096 | 2 | 0.96 | 32 | 2 | 0.64 (3) |
| 4 | 4 | 102 | 39.9 | 39.9 | 20736 | 3 | 1.28 | 48 | 3 | 0.64 (3) |
| 5 | 8 | 203 | 26.6 | 6.6 | 16 | 1 | 1.28 | 4 | 0.25 | 0.64 |
| 6 | 8 | 203 | 26.6 | 26.6 | 256 | 1 | 2.56 | 16 | 1 | 1.28 |
| 7 | 8 | 203 | 53.2 | 53.2 | 4096 | 2 | 3.84 | 32 | 2 | 2.56 (3) |
| 8 | 8 | 203 | 79.8 | 79.8 | 20736 | 3 | 5.12 | 48 | 3 | 2.56 (3) |
| 9 | 16 | 406 | 53.2 | 13.3 | 16 | 1 | 5.12 | 4 | 0.25 | 2.56 |
| 10 | 16 | 406 | 53.2 | 53.2 | 256 | 1 | 10.24 | 16 | 1 | 5.12 |
| 11 | 16 | 406 | 106.4 | 106.4 | 4096 | 2 | 15.36 | 32 | 2 | 10.24(3) |
| 12 | 16 | 406 | 159.6 | 159.6 | 20736 | 3 | 20.48 | 48 | 3 | 10.24(3) |
| 13 | 32 | 813 | 106.4 | 26.6 | 16 | 1 | 20.48 | 4 | 0.25 | 10.24 |
| 14 | 32 | 813 | 106.4 | 106.4 | 256 | 1 | 40.96 | 16 | 1 | 20.48 |
| 15 | 32 | 813 | 212.8 | 212.8 | 4096 | 2 | 61.44 | 32 | 2 | 40.96(3) |
| 16 | 32 | 813 | 319.2 | 319.2 | 20736 | 3 | 81.92 | 48 | 3 | 40.96(3) |

Assumptions:

(1) At imaging drum rotation speed of 3600 RPM, and assuming no waiting for data.

(2) At a net serial data rate of 10 Mbps.

(3) Density bits are binary coded. When encoding results in 5 or 6 bits the bit field is filled to 8 bits for formatting efficiency. Similarly, 12 bit fields are filled to 16 bits.

Formulas and Notes

Print area per page, $A_p$ = 200mm x 250mm = $5 \times 10^4$ ($mm^2$).

Printhead extends along the long dimension of the page.

Rotation speed of imaging drum, $\omega$ = 3600 revolutions per minute.

Net serial data rate, $D_s = 10^7$ (bits/sec).

Paper speed, $S_p$ = pixel length (mm) x $\omega$ revs/min x pixel lines/rev x min/60 sec (mm/sec).

Print time per page, $T_p$ = page width (mm)/$S_p$ (sec).

Pixels per page, $P_p = A_p$ x pixels/$mm^2$ (pixels).

Bits per page, $B_p = P_p$ x density bits/pixel (bits).

Data load time per page, $L_p = B_p/D_s$ (secs).

Table 1